US005362190A

United States Patent [19]

Eaton

[11] Patent Number: 5,362,190

[45] Date of Patent: Nov. 8, 1994

[54] METHOD FOR GATHERING CUT TOBACCO STALKS

[76] Inventor: Jay S. Eaton, Rte. 2, Buladean, Bakersville, N.C. 28705

[21] Appl. No.: 986,679

[22] Filed: Dec. 8, 1992

[51] Int. Cl.[5] ..... A24B 1/06

[52] U.S. Cl. ..... 414/26; 211/59.1; 211/125; 414/786

[58] Field of Search ..... 414/26; 56/27.5; 294/5.5; 52/105; 211/59.1, 125; 248/175, 520

[56] References Cited

U.S. PATENT DOCUMENTS

| | | | |
|---|---|---|---|
| 1,813,292 | 7/1931 | Hord | 294/5.5 |
| 1,992,857 | 2/1935 | Breedlove | 294/5.5 |
| 2,277,317 | 3/1942 | Gilbert | 294/5.5 |
| 3,165,208 | 1/1965 | Lewis . | |
| 3,262,587 | 7/1966 | Anderson . | |
| 3,411,739 | 11/1968 | Barfield | 248/175 |
| 4,091,601 | 5/1978 | Riggins | 414/26 |
| 4,361,002 | 11/1982 | Swetnam et al. . | |
| 4,578,935 | 4/1986 | King | 56/27.5 |
| 4,649,678 | 3/1987 | Lamson . | |
| 5,081,827 | 1/1992 | Kennedy | 414/26 |

FOREIGN PATENT DOCUMENTS

| | | | |
|---|---|---|---|
| 822635 | 10/1959 | United Kingdom | 248/520 |

*Primary Examiner*—Michael S. Huppert

*Assistant Examiner*—Gregory A. Morse

*Attorney, Agent, or Firm*—Dority & Manning

[57] ABSTRACT

An apparatus is provided for increasing the efficiency of gathering cut tobacco stalks, particularly burley tobacco stalks. The apparatus includes a metal tobacco stick being of a length sufficient so that the stick can be pushed into the ground with a portion thereof remaining above ground for supporting a plurality of cut tobacco stalks which are to be impaled thereon. A spear tip is provided and adapted to be fitted to the end of the tobacco stick above the ground. The spear tip also provides a worker with a means for grasping and pushing the tobacco stick into the ground. The spear tip has a cross-sectional area which is greater than that of the tobacco stick but generally less than that of the cut tobacco stalks so that the stalks can be threaded onto the stick by forcing the stalk onto the spear tip and subsequently sliding the stalk down onto the tobacco stick. The apparatus further calls for a cradle for supporting at least the butt ends of the cut tobacco stalks off the ground at a sufficient height so that a worker in a relatively fluid and continuous motion can pick a stalk from the cradle and impale the stalk onto the tobacco stick without repeatedly bending over. A method is also provided for utilizing the apparatus according to the present invention for gathering cut tobacco stalks, particularly burley tobacco stalks.

5 Claims, 3 Drawing Sheets

METHOD FOR GATHERING CUT TOBACCO STALKS

BACKGROUND OF THE INVENTION

The present invention relates to a method and apparatus for gathering cut tobacco stalks and more particularly relates to a method for efficiently gathering cut burley tobacco stalks using far less effort and man hours than required by previous conventional methods.

Tobacco plants grow as relatively tall stalks with the tobacco leaves growing radially out from the stalks. In the case of air dried tobacco, particularly burley tobacco, the tobacco stalks are cut down either manually or with a mowing device and left in the field for a short period of time for field curing. Conventionally, wooden stakes would then be driven into the ground by workers at various positions in the tobacco field. The wooden stakes, however, have proven to be inefficient, cumbersome, and often destructive to the tobacco stalks. Also, use of wooden stakes is relatively labor intensive requiring generally more than one worker to place and hammer the stakes into the ground. The wooden stakes are not of sufficient weight or strength so that a worker could simply push the stake into the ground under his own weight. Conventionally, the worker would also need a mallet or other device to drive the stake into the ground. A conical tip or point would then be placed upon the stake after it has been driven into the ground whereby a worker could impale a tobacco stalk onto the stake by forcing the stalk down onto the conical tip. However, this method has also proven ineffective and often damaging to the tobacco stalk. The cross-sectional area of the wooden stakes is relatively large and, in many instances, the process of driving the stalk over the conical point and down onto the wooden stake would split the tobacco stalk. Once the tobacco stalk was split, there was a high probability that the stalk would not hang from the stake in the curing cells.

Another drawback of the conventional methods and apparatus is that once the tobacco was field cured, it was relatively difficult for a worker to withdraw the wooden stake from the ground since the stake was hammered into the ground previously. Often, excessive force would be needed to retrieve the wooden stakes with tobacco stalks threaded thereon from the ground.

The known methods have also proven labor intensive and wasteful in that, previously, workers expended much energy and time bending over to pick the tobacco stalks off the ground and then raising up to thread the tobacco stalks onto the wooden stakes. Thus, if a worker desired to spear six tobacco stalks onto a stake, he would have to repeat the bending and raising exercise at least six times per tobacco stake. Also, if the tobacco stake was not sufficiently driven into the ground, the wooden stakes tended to fall over under the weight of the tobacco stalks or due to adverse weather.

In my co-pending U.S. patent application Ser. No. 07/842,231, I have described an alternative to the conventional methods of harvesting the cut tobacco stalks which employs an elevating scaffold trailer including a clamping device wherein the tobacco rods, which can be metal, are held substantially horizontal to the ground in the clamping device. In this manner, a worker could easily impale three tobacco stalks on each side of the clamp. After the tobacco rod was full, it is a relatively easy procedure for the worker to release the rod from the clamp and place the tobacco rod on the scaffold trailer.

OBJECTS AND SUMMARY OF THE INVENTION

It is a principle object of the present invention to provide a method for efficiently gathering cut tobacco stalks greatly reducing the manpower needed for such operation.

It is an also object of the present invention to provide an apparatus aiding in a more efficient method of gathering cut tobacco stalks.

Still a further object of the present invention is to provide a method and apparatus for use therewith which greatly reduces the physical labor requirements, particularly bending over, required for gathering cut tobacco stalks.

Yet another object of the present invention is to provide a method and apparatus for gathering cut tobacco stalks wherein a single worker can efficiently gather what previously required at least two workers.

Yet a further object of the present invention is to provide an apparatus for gathering tobacco stalks which greatly reduces the possibility of stalk splitting.

And still a further object of this invention is to provide a procedure and apparatus for harvesting tobacco weighing over 2400 pounds per acre.

Additional objects and advantages of the invention will be set forth in part in the description which follows, and in part will be obvious from the description or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an apparatus is provided for gathering cut tobacco stalks, particularly burley tobacco stalks. The apparatus includes a metal tobacco stick or spear. The metal tobacco stick has a sufficient length so that the tobacco stick can be manually pushed into the ground by a single worker with a sufficient portion thereof remaining above ground for supporting a plurality of cut tobacco stalks which will be impaled thereon. The apparatus also includes a spear tip which is adapted to be fitted to one end of the tobacco stick. The spear tip has a cross-sectional area which is greater than that of the tobacco stick and less than that of the cut tobacco stalks. In this manner, the stalks can be threaded onto the tobacco stick by being forced onto the spear tip so that the spear tip pierces the stalks and whereby the stalks can be subsequently slid down onto the tobacco stick. In a preferred embodiment of the apparatus of the invention, the spear tip has a generally hollow shaft portion so that the spear tip can be fitted over an end of the tobacco stick.

The apparatus also includes a cradle for supporting at least the butt ends of the cut tobacco stalks off the ground at a sufficient height so that a worker can, in a relatively fluid and continuous motion, pick a stalk from the cradle and impale the stalk onto the tobacco stick without the necessity of repeatedly bending over to retrieve the tobacco stalks.

In a preferred embodiment of the apparatus of the invention, the tobacco sticks according to the invention comprise an approximately $\frac{3}{8}$ inch steel rod. In a preferred embodiment the $\frac{3}{8}$ inch steel rod is a conventional concrete reinforcing rod. It is also preferred to form at least one end, preferably both ends, of the tobacco stick into a point so that the tobacco stick can more easily be driven into the ground. The tobacco stick can be of any sufficient length with one preferred embodiment being approximately 60 inches long.

In a preferred embodiment of the apparatus, the spear tip comprises an approximately one-half inch generally hollow pipe portion or shaft portion. The cross-sectional area of the shaft portion is such that it easily slides over the tobacco stick yet is significantly less than the general cross-sectional area of the cut tobacco stalks. In this manner, the stalks can be impaled by the spear tip and slid down onto the tobacco stick without splitting the tobacco stalks.

And yet another preferred embodiment of the apparatus of this invention, the cradle comprises a structure having supporting legs, preferably three such legs, and defines a concave receiving portion for supporting at least the cut butt ends of the tobacco stalks off the ground. In a preferred embodiment, the cradle is adjustable in height by, for example, adjusting one or more of the legs of the cradle. In one preferred embodiment of the cradle, rigid members are formed into the general shape of an "M" with the incline sides of the cradle forming the concave receiving portion.

In still further accordance with the purposes of the present invention, a method is provided for gathering tobacco stalks, particularly burley tobacco stalks. The method includes the first step of hand cutting or machine mowing the tobacco stalks in the field. Next, a worker or workers arrange the cut tobacco stalks into piles of a predetermined number of stalks, for example, six stalks per pile. After the stalks have been arranged into piles, the worker or workers then temporarily place a steel tobacco stick in relatively close proximity to each pile of stalks. The steel tobacco stick is preferably pushed into the ground only slightly by the worker just enough so that the stick stands up where it is positioned. The steel stick may also be placed on the ground in relatively close proximity to the pile of stalks. The cut and piled tobacco is then allowed to wilt for approximately six hours, or a longer time if necessary. After sufficient wilt has occurred, a worker then positions a cradle beside a particular pile of cut stalks with the concave portion of the cradle being positioned in relatively close proximity to the cut butt ends of the tobacco stalks. The worker then lifts all of the cut stalks onto the cradle so that at least the butt ends of the stalks are carried in the concave portion of the cradle. A worker then retrieves the previously temporarily placed tobacco stick and positions the tobacco stick in comfortable proximity to the loaded cradle. The worker then places the spear tip onto the tobacco stick and, grasping the spear tip, manually pushes the stick into the ground a sufficient depth. Then, in a relatively continuous motion, the worker is able to pick individual tobacco stalks from the cradle and thread the stalks onto the tobacco stick by impaling the butt ends of the stalks onto the pointed spear tip and subsequently sliding the stalk down onto the tobacco stick. In this manner, the worker can thread the entire pile of tobacco stalks onto the stick without the necessity of repeatedly bending over to retrieve each individual stalk from the ground. In this manner, the time necessary to thread an entire pile of stalks is greatly reduced and the worker simply picks up his cradle and moves onto the next pile of stalks and repeats the process.

It should be understood that the steps of the method just described are in a preferred sequence but, other sequences are within the scope and spirit of the invention. For example, it is within the present invention to position the cradle in relatively close proximity to the prepositioned steel stick instead of repositioning the temporarily placed stick. Alternately, the worker may place the spear tip onto the stick after pushing the stick into the ground. It should be understood that various modifications of the present method are within the scope of this invention.

In a preferred embodiment of the present method, the stalks are arranged into piles of six stalks each.

The present method may also include the additional step of easily extracting the tobacco sticks with the stalks threaded thereon from the ground after a sufficient period of time for field curing the tobacco has passed. The tobacco sticks and stalks threaded thereon can then be transported to a curing cell for further curing with means of, for example, the elevating scaffold trailer described in my pending U.S. application Ser. No. 07/842,231.

The present method may also include the step of unthreading or extracting the tobacco stalks from the steel sticks after the stalks have cured in the curing cell for further market preparation. Extracting the tobacco stalks from the tobacco sticks is a relatively easy procedure due to the relatively thin cross-sectional area of the tobacco sticks. The accompanying drawings, which are incorporated in and constitute a part of the specification, illustrate one embodiment of the invention, and together with the description serve to explain the principles of the invention.

BRIEF DESCRIPTION OF THE DRAWINGS

A full and enabling disclose of the present invention, including the best mode thereof, directed to one of ordinary skill in the art, is set forth in the remainder of the specification, which makes reference to the appended figures in which.

Figure 1:
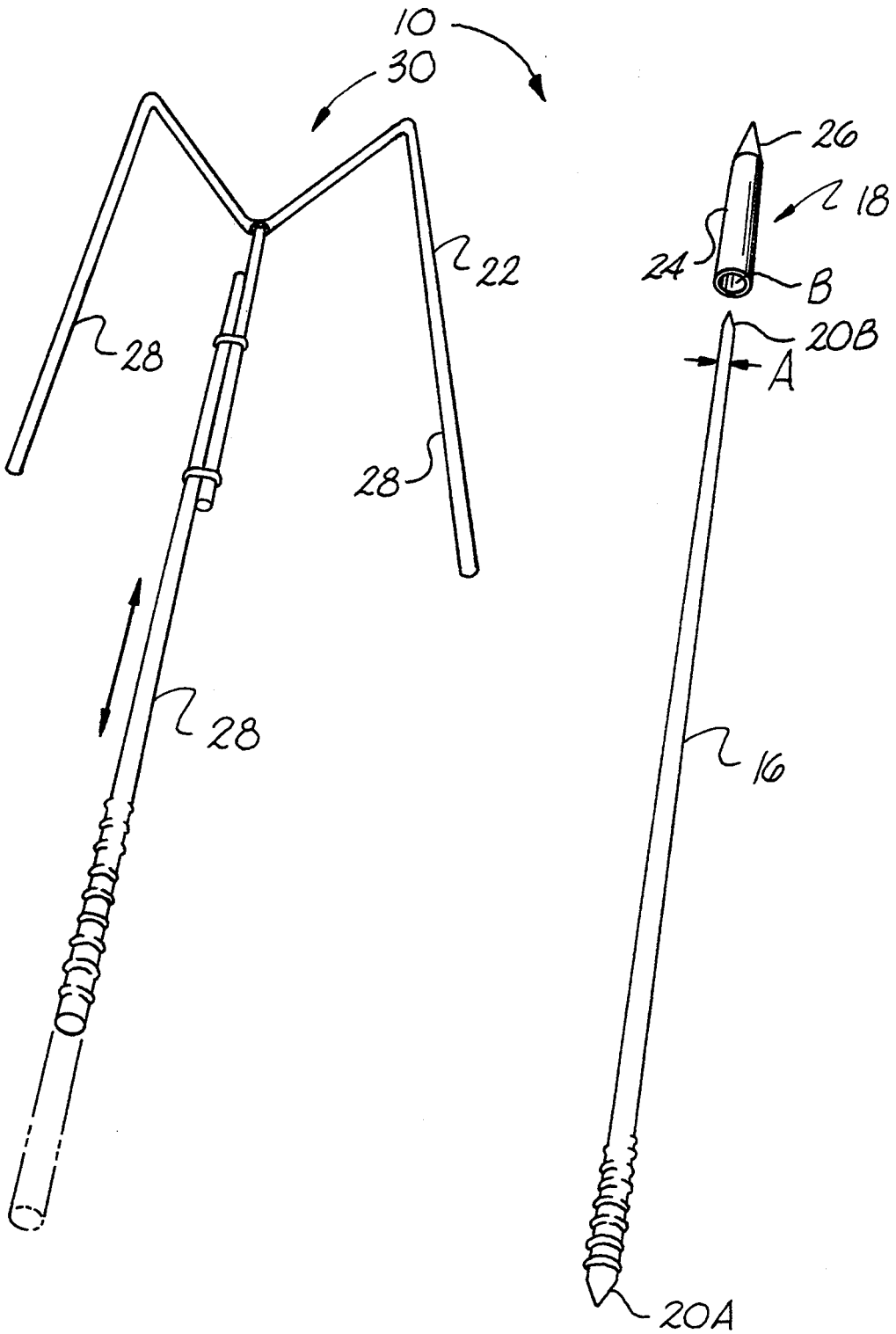
FIG. 1 is a perspective component view of a preferred embodiment of the apparatus according to the invention.

Repeat use of reference characters in the following specification and appended drawings is intended to represent the same or analogous features, elements, or steps of the present invention.

BRIEF DESCRIPTION OF THE PREFERRED EMBODIMENTS

Reference will now be made in detail to the presently preferred embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a further embodiment. Thus, it is intended that the present invention cover such modifications and variations as come within the scope of the appended claims and their equivalents.

Referring to FIG. 1, apparatus 10 is illustrated for use in gathering cut tobacco stalks, particularly burley tobacco stalks 12. Apparatus 10 includes a metal tobacco stick 16. Tobacco stick 16 is preferably formed of steel and can comprise, for example, a length of conventional concrete reinforcing rod. Preferably, stick 16 is a ⅜ inch steel rod. It is important that stick 16 be of sufficient weight and length so that stick 16 can be easily driven into the ground with the portion remaining above ground being of sufficient length to support a plurality of tobacco stalks which will be impaled thereon. Thus, it should be understood, that a lightweight or hollow rod would not be preferred in that the stick 16 would necessarily need to be driven into the ground with greater effort from a worker. By utilizing a solid steel ⅜ inch rod, it is relatively easy for a worker to manually push or lean stick 16 into the ground with relatively little effort. To aid in pushing stick 16 into the ground, it is preferred that at least one end 20 of stick 16 be formed into a point, with the pointed end 20 being pushed into the ground. It is preferred that both ends of stick 16 be formed into a point for versatility and ease of adaptability of stick 16. In a preferred embodiment, stick 16 is approximately 60 inches long. This is a sufficient length and provides enough weight to stick 16 so that the stick can be easily pushed into the ground by an individual without hammering or excessive force with a sufficient portion thereof remaining above ground for supporting a plurality of tobacco stalks thereon.

It is an important consideration of the present apparatus that the diameter A of the round stick is significantly less than the diameter of the cut tobacco stalks. In this way, the probability of splitting the tobacco stalks when impaling the stalks onto the tobacco sticks 16 is significantly reduced. A ⅜ inch steel rod has been found to be a preferred embodiment in this regard. It is also strong enough and heavy enough to be driven into the ground and remain substantially vertical under the weight of a plurality of stalks impaled thereon without giving or bending during adverse weather conditions. Stick 16 must also be of sufficient strength to support the weight of the tobacco stalks 12 hanging therefrom when stick 16 is eventually placed in a curing cell.

Apparatus 10 also includes a spear tip 18 which is adapted to be fitted onto an end 20*b* of stick 16. Preferably, spear tip 18 has a generally hollow shaft portion 24. Shaft portion 24 has an inside diameter B which is greater than diameter A of stick 16. In this manner, spear tip 18 can be readily fitted over stick 16. In another embodiment of the invention, stick 16 and spear tip 18 may be positively mated by, for example, a threaded connection between the two components. It is preferred, however, that tip 18 and stick 16 be relatively loose fitting to aid in relatively quick assembly and disassembly. In another embodiment of tip 18 not illustrated in the figures, the spear tip may be fitted upon stick 16 by, for example, a shaft or lead portion fitting into a hollowed out portion within stick 16. Spear tip 18 also provides a means for a worker to grasp stick 16 for manually pushing the stick into the ground.

As illustrated in FIG. 1, it is preferred that the maximum diameter B of any portion of spear tip 18 be only slightly greater than that of stick 16 so as not to increase the possibility of splitting the tobacco stalks. Additionally, the increased diameter B serves to make a relatively greater cross-sectional penetration through stalk 12 than would be required by stick 16. In this manner, once the stalk is slid past tip 18, the stalk easily slides down stick 16 with very little external force being applied thereto. Likewise, it is relatively easy to remove the stalks from the stick once the stalks have been cured and the tobacco is processed further for market.

It should be understood that, although depicted in the figures as round, that tobacco stick 16 and tobacco spear tip 18 could also be rectangular or square or any other shape.

Apparatus 10 further includes a cradle 22 depicted generally in the figures. Cradle 22 is for supporting at least the butt ends 14 of stalks 12 off of the ground at a sufficient height so that a worker can, in a relatively fluid and continuous motion, pick the individual stalks up from the cradle and impale the stalks onto tobacco stick 16 without repeatedly bending over. This concept is depicted generally in FIG. 2.

Figure 2:
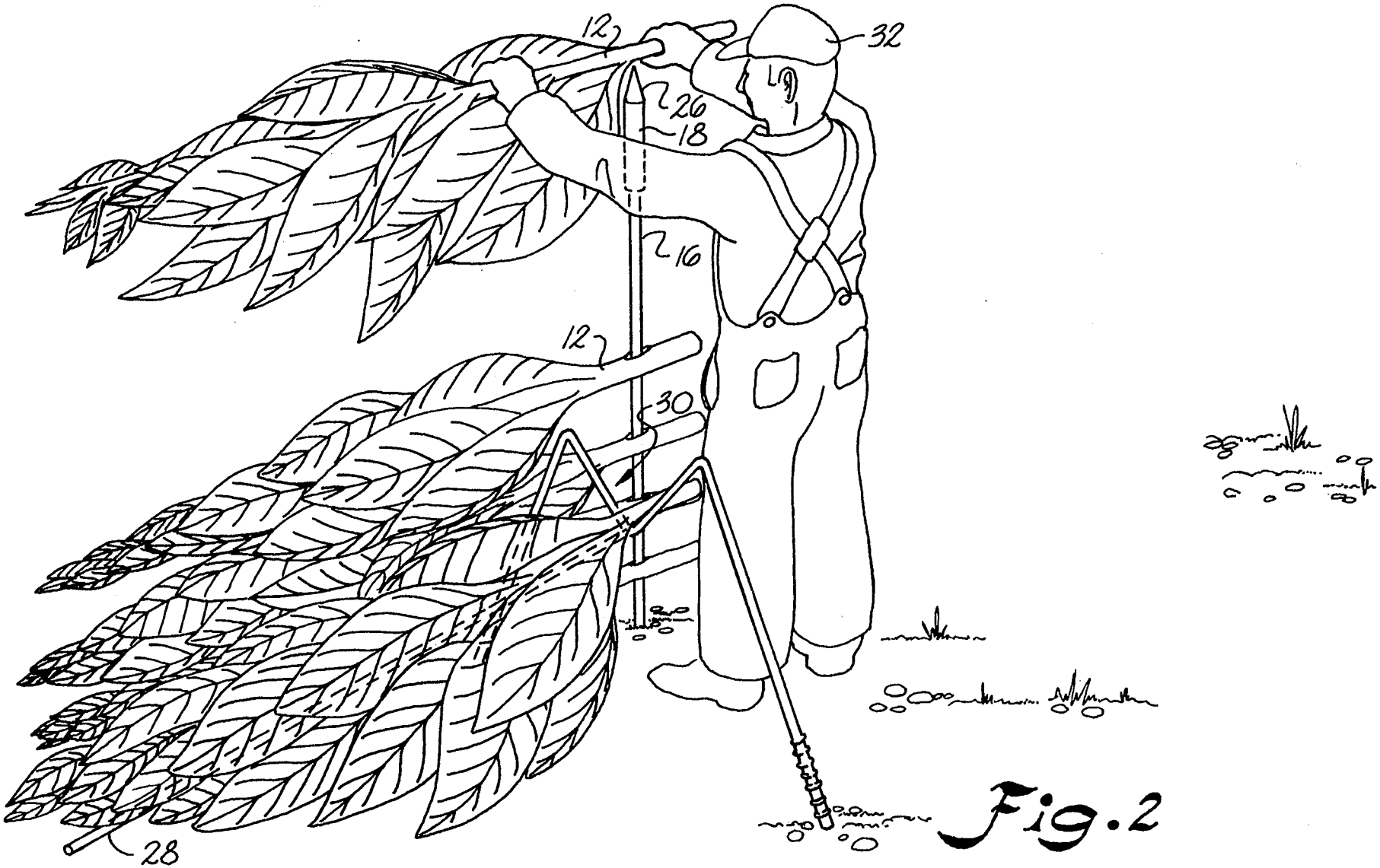
FIG. 2 is a perspective representation of the apparatus according to the invention in use and particularly illustrates the relationship between the components.
Figure 2A:
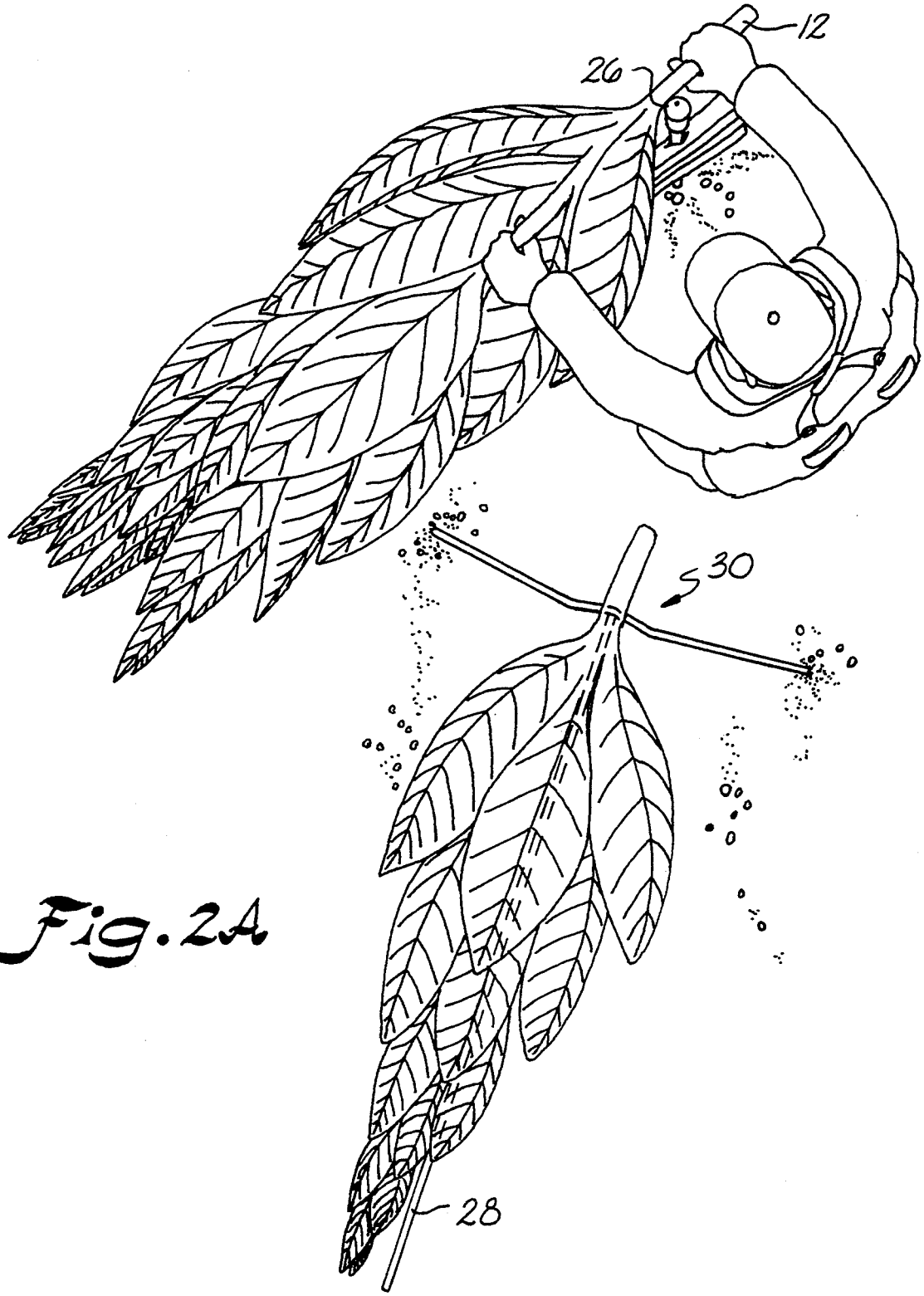
FIG. 2*a* is a perspective top view of the embodiment shown in FIG. 2.

Cradle 22, in a preferred embodiment thereof, is depicted in FIGS. 1 and 2 as a generally skeletonal structure having legs 28 for holding cradle 22 erect. In a preferred embodiment, at least one leg 28 of cradle 22 is adjustable in length so that the height of cradle 22 can be varied. Cradle 22 defines a recessed portion 30 wherein at least the butt ends 14 of stalks 12 can be placed.

It should be understood that the embodiment of cradle 22 depicted in the figures is but one example of a suitable cradle for use in the present invention. For example, cradle 22 may be formed of walls and be a more boxlike structure. In an alternative embodiment, cradle 22 may comprise a relatively simple "Y" shaped structure which could be merely pressed or forced into the ground around the pile of tobacco stalks. It should be understood that cradle 22 can employ any variety of structure. Likewise, recessed portion 30 need not necessarily be defined by two inclined sides as shown in the figures but, can comprise a semicircular structure or like arrangement. For example, a curved or bowed member may be supported between legs 28 to form receiving portion 30. Additionally, cradle 22 may be portable in that the structural components comprising the cradle may be folded or disassembled by the worker. For example, cradle 22 may operate similar to a conventional camera tripod or similar device.

In operation and in accordance with the method of the present invention, as generally depicted in FIG. 2, a worker 32 may utilize the apparatus 10 of the present invention according to the following steps. First, the tobacco is hand cut or machine cut in the field. The worker then arranges the cut tobacco stalks into piles of a predetermined number of stalks, preferably six stalks per pile. Next a single worker or workers canvas the tobacco field and place a tobacco stick in relatively close proximity to each pile of tobacco stalks. It is preferred that the workers press the tobacco sticks into the ground only to a sufficient degree so that the sticks will stand up so as to be relatively easy to locate at a later time. Alternatively, the sticks could be laid on the ground next to each pile of stalks. The piled tobacco stalks are allowed to wilt in the field for approximately six hours, or a longer period if necessary, for example overnight. Once the stalks have wilted, a worker approaches the piled stalks with a cradle 22 according to the apparatus of the invention and positions the cradle so that the concave portion 30 thereof is in relatively close proximity to the cut butt ends of the tobacco stalks. If the cradle is designed according to the embodiment of FIG. 1, the worker places the long leg 28 of cradle 22 substantially aligned with the tobacco stalks, as shown generally in FIG. 2. The worker then reaches over and gathers all of the ends of the cut tobacco stalks and places at least the cut butt ends of the stalks into the concave portion of the cradle. Next, the worker retrieves the previously positioned tobacco stick and selects a position for the stick in close proximity to the cradle and stalks supported thereon. The worker then fits the tobacco spear tip onto the end of the stick and, grasping the spear tip, pushes the tobacco stick into the ground to a sufficient depth so that the stick will remain vertical with the tobacco stalks impaled thereon. Due to the weight of the tobacco stick and the fact that at least the end of the stick being pushed into the ground is preferably formed into a point, a worker can easily penetrate the ground by simply leaning on or pushing the stick without the necessity of hammering the stick into the ground.

At this point, the worker is ready to spear the tobacco stalks onto the tobacco stick. Preferably, the worker has positioned the stick relative to the cradle so that the worker merely has to position himself between the cradle and stick and, in a relatively fluid and continuous motion, retrieve the individual stalks from the cradle and, by grasping the stalks between both hands, impaling the butt end of the stalk onto the spear tip and then down onto the tobacco stick as is generally shown in FIG. 2.

After the tobacco stalks have field cured for a sufficient period of time, it is a relatively easy procedure for an individual worker to pull the tobacco stick from the ground with little effort and transport the stick with stalks hanging therefrom to a curing cell for further curing. Preferably, the tobacco stick with stalks hanging therefrom is placed on an elevating scaffold trailer as described generally in my pending U.S. patent application Ser. No. 07/842,231.

Once the tobacco has cured sufficiently and, if desired, brought in case, it is a relatively easy procedure for a worker to extract the tobacco stalks from the sticks. Due to the relatively small cross-sectional area of the stick, the stalks tend not to clamp down onto the stick during curing.

It should be understood by those skilled in the art that the above method described for utilizing the apparatus of the present invention is but merely one illustration of the use of the present invention. The steps described above or arrangement of components of the invention, can be varied or modified as desired by the worker to more efficiently fit a personal style preference. For example, the tobacco stalks need not necessarily be placed in the cradle so as to be oriented with the long leg thereof. Various modifications of the present apparatus and method for use can be devised by those skilled in the art and fall within the spirit of the present invention. Thus, it is intended that the present invention cover the modifications and variations of this invention provided they come within the scope of the appended claims and their equivalents.

What is claimed is:

1. A method for gathering cut burley tobacco stalks, said method comprising the steps of:

arranging the cut tobacco stalks into piles of a predetermined number of stalks;

temporarily positioning a solid steel tobacco stick relatively close to each pile of stalks;

positioning a cradle on the ground in relatively close proximity to the pile of tobacco stalks, the cradle having a concave portion defined therein for supporting the tobacco stalks off the ground;

placing at least the cut butt ends of the tobacco stalks into the concave portion of the cradle so that the stalk ends are at a height at least greater than a worker's knees above the ground;

fitting a pointed spear tip onto the tobacco stick;

manually driving the tobacco stick into the ground in close working proximity to the cradle and tobacco stalks; and in a relatively continuous motion, picking up individual tobacco stalks from the cradle and threading the stalks onto the tobacco stick by impaling the butt ends of the stalks onto the pointed spear tip and sliding the stalk down onto the tobacco stick without the necessity of bending over to retrieve the stalks from the cradle, said manually driving step including ensuring the tobacco stick is forced into the ground a sufficient amount so as to remain substantially vertical under the weight of the tobacco stalks threaded thereon.

2. The method as in claim 1, wherein said arranging step comprising sorting the cut tobacco stalks into piles of six stalks each.

3. The method as in claim 1, including the additional step of extracting the tobacco stick with stalks threaded thereon from the ground after a sufficient period of time for field curing the tobacco and transporting the tobacco stick and tobacco stalks hanging therefrom to a curing cell for further curing.

4. The method as in claim 1, including the additional step of allowing the tobacco stalks to wilt in the arranged piles prior to said threading step.

5. The method as in claim 3, including the additional step of removing the tobacco stalks from the tobacco sticks after curing for further processing for market.

* * * * *